United States Patent [19]

Nance

[11] Patent Number: 5,009,289

[45] Date of Patent: Apr. 23, 1991

[54] BLOWOUT PREVENTER STRING SUPPORT

[75] Inventor: James G. Nance, Spring, Tex.

[73] Assignee: Cooper Industries, Inc., Houston, Tex.

[21] Appl. No.: 28,743

[22] Filed: Mar. 23, 1987

[51] Int. Cl.[5] ..... E21B 33/06

[52] U.S. Cl. ..... 188/67; 251/1.3; 294/102.2

[58] Field of Search ..... 251/1.1, 1.2, , 1.3; 188/67; 294/102.2; 277/30, 192

[56] References Cited

U.S. PATENT DOCUMENTS

| | | | |
|---|---|---|---|
| 1,548,265 | 8/1925 | Hall | 294/102.2 |
| 2,542,302 | 2/1951 | Barker | 285/22 |
| 3,017,931 | 1/1962 | Jackson et al. | 166/208 |
| 3,472,535 | 10/1969 | Kinley | 188/67 |
| 4,403,389 | 8/1977 | Cobb | 166/55 |
| 4,647,002 | 3/1987 | Crutchfield | 251/1.3 |

*Primary Examiner*—Robert J. Oberleitner
*Assistant Examiner*—Mark T. Le

[57] ABSTRACT

An improved string support apparatus used with a ram type blowout preventer in which improved gripping assemblies, each having a bowl body and gripping elements, are positioned in the front face packer recess or recess of the rams which is normally occupied by a ram packer. In such rams, a top seal is used and positioned in a groove in the ram body which extends from side to side across the top of the ram body and the packer extends across the face of the ram and has pins at each side extending into openings in the ram body which are engaged and secured by pins extending from the top seal into openings which intersect with the openings for the packer pins. The bowl body has the general shape of the back of the packer so that it fits into the packer slot in the ram body and it also includes the pins which extend into the openings in the ram body at each side which are secured in place by engagement with the top seal pins. Gripping members or slips are positioned on the arcuate tapered front face of the bowl body and are free to move vertically thereon. The gripping members are biased upwardly by springs. This provides gripping assemblies which are easily and quickly substituted for the packers in the rams of a ram type blowout preventer.

12 Claims, 3 Drawing Sheets

BLOWOUT PREVENTER STRING SUPPORT

BACKGROUND

It has been the practice in running strings into a well through a ram type blowout preventer connected at the wellhead to support the string by closing the blowout preventer rams on the string immediately below a collar or an upset shoulder in the string so that the rams support the string and the string can be released from the travelling block so that other operations, such as adding a section to the string, may be performed.

Efforts have been made to incorporate gripping elements into the face of the face of the ram. An example of this is shown in the prior application Ser. No. 06/853,601, filed Apr. 18, 1986. This application discloses a ram type blowout preventer which is intended to close on two strings at the same time, sealing against both strings and bringing gripping elements into engagement with the strings so that the strings are supported on the rams.

Another prior structure is disclosed in the U.S. Pat. No. 4,043,389. This structure is a ram type blowout preventer having an upper set of rams to seal against the string extending through the preventer and a lower unit which includes a slip bowl secured to each ram arm which extends into the guideways from the pressure responsive means and a plurality of slips positioned on the tapered front face of each bowl, with the two outer slips being secured by resilient straps to the bowl and the other slips being interengaged with each adjacent slip by a connecting member. In this structure, the bowls function as the rams of a normal blowout preventer and when moved inward into the central bore function to bring the slips into engagement with the string. As the slips engage the string and assume the load they are forced downward and the taper on the face of the bowl causes them to be wedged tighter against the string.

Two other U.S. Pat. Nos. 2,542,302 and 3,017,931 disclose rams having slip assemblies mounted thereon and means for moving the rams into the bore of the wellhead to bring the slip assemblies into supporting engagement with a string extending therethrough.

SUMMARY

The present invention relates to an improved string support apparatus used with a ram type blowout preventer in which the bowl and gripping elements are an assembly which fits into the front face recess or slot of a ram which is normally occupied by a ram packer. In such rams, a top seal is used and positioned in a groove in the ram body which extends from side to side and the packer extends across the face of the ram and has pins at each side extending into openings in the ram body which are engaged and secured by pins extending from the top seal into openings which intersect with the openings for the packer pins. The slip bowl has the general shape of the back of the packer so that it fits into the face slot on the ram body and it also includes the pins which extend into the openings in the packer body at each side which are secured in place by engagement with the top seal pins. A plurality of gripping members or slips are mounted on the arcuate tapered front face of the bowl body to slide vertically on such taper and are biased upwardly. This provides a gripping assembly which is easily and quickly substituted for the packer in the ram of a ram type blowout preventer.

An object of the present invention is to provide an improved blowout preventer which can be used to support a string extending therethrough.

Another object is to provide an improved gripping assembly which can be installed in the packer slots in the faces of blowout preventer rams.

A further object of the present invention is to provide an improved gripping assembly for a ram type blowout preventer which is readily installed in the blowout preventer rams.

BRIEF DESCRIPTION OF THE DRAWINGS

These and other objects and advantages are hereinafter set forth and explained with respect to the drawings wherein.

DESCRIPTION OF THE PREFERRED EMBODIMENT

Figure 1:
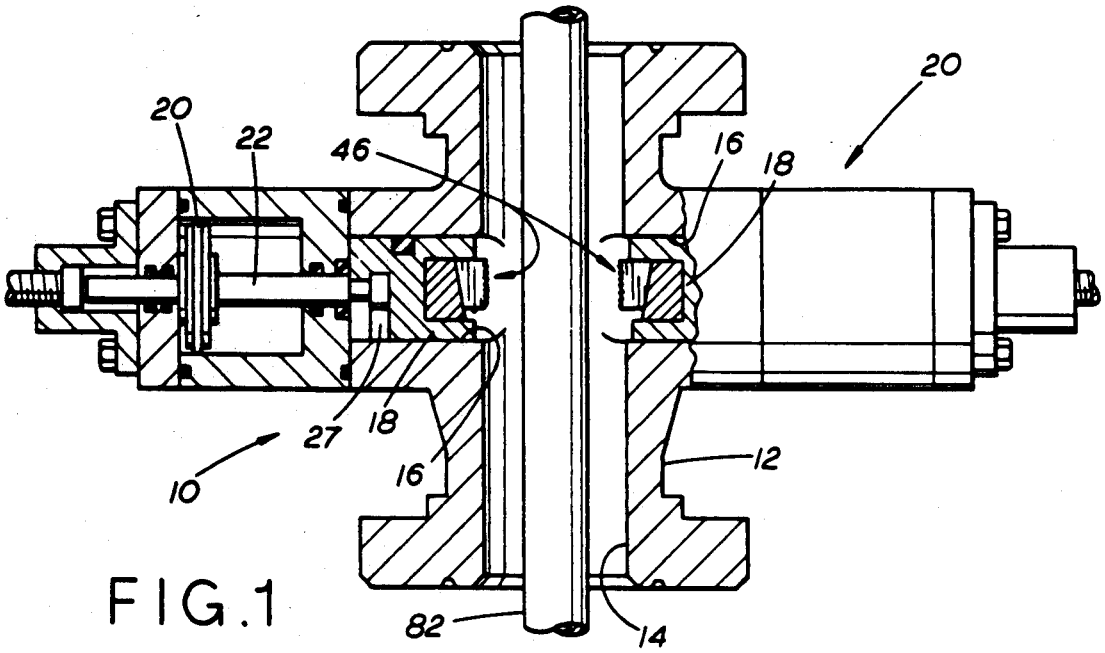
FIG. 1 is a sectional view of a blowout preventer of the present invention.

Blowout preventer 10 includes body 12 having central bore 14 extending therethrough with opposed, aligned ram guideways 16 extending outward from central bore 14. One of rams 18 is positioned in each guideway 16 and is connected to pressure responsive means or piston 20 by connecting rod 22 to move rams 18 into central bore 14 and retract rams 18 into their respective guideways 16.

Figure 2:
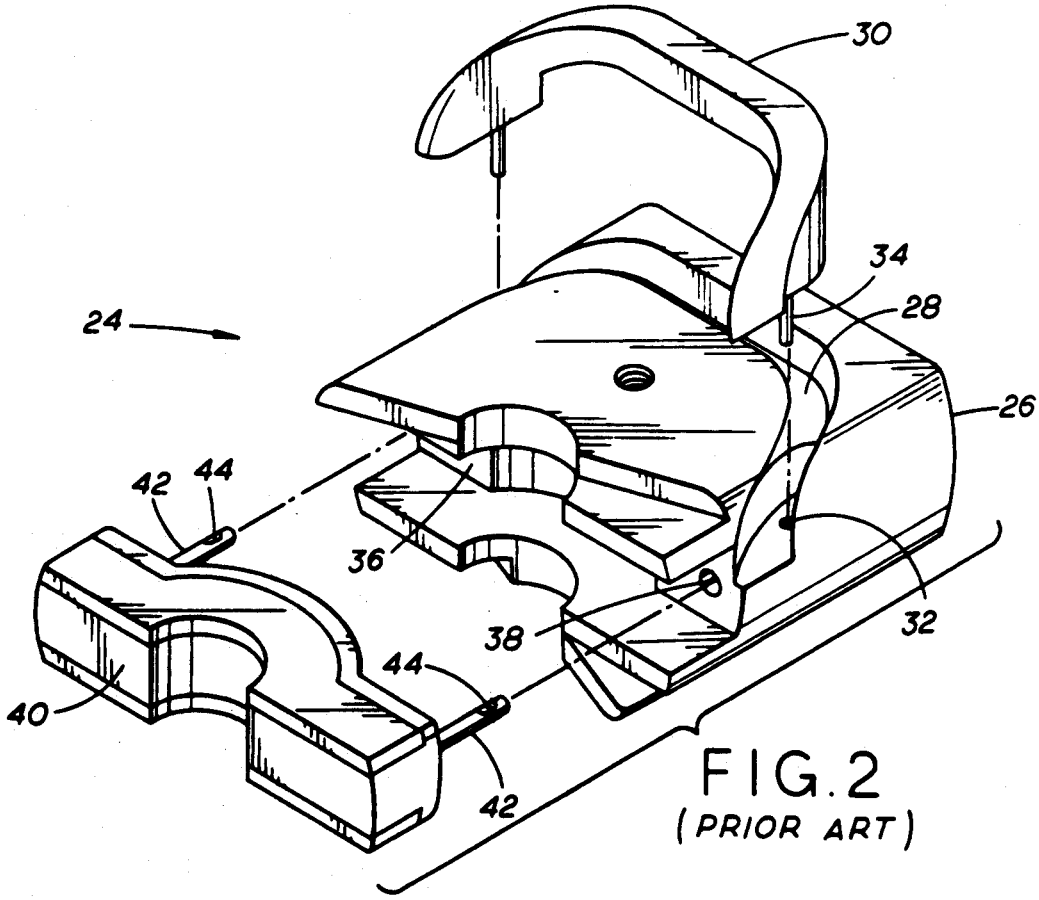
FIG.2 (PRIOR ART)
FIG. 2 is an exploded view of a prior art sealing ram.

In the past blowout preventers such as preventer 10 have included a ram packer extending across the face of the ram. Such packing ram 24 is illustrated in FIG. 2 and includes ram body 26 which has a suitable slot (not shown) on its rear face for the connection to the connecting rod 22, a groove 28 which extends from side to side across the top of ram body 26 and into which top seal 30 is adapted to be positioned. At each side of ram body 26, holes 32 extend downward into body 26 to receive locking pins 34 extending downward from the ends of top seal 30. Packer slot 36 extends across the front face of ram body 26 and holes 38 extend into ram body 26 at each side thereof to intersect with holes 32. Packer 40 is positioned within packer slot 36 and pins 42 which extend rearward from each side of packer 40 are received within holes 38. Pins 42 include openings 44 extending vertically therethrough. Packer 40 is installed within packer slot 36 with its pins 42 being within holes 38 and then top seal 30 in installed within groove 28 and its locking pins 34 extend through holes 38 and through openings 44 in pins 42 to lock packer 40 in position within its packer slot 36.

Figure 3:
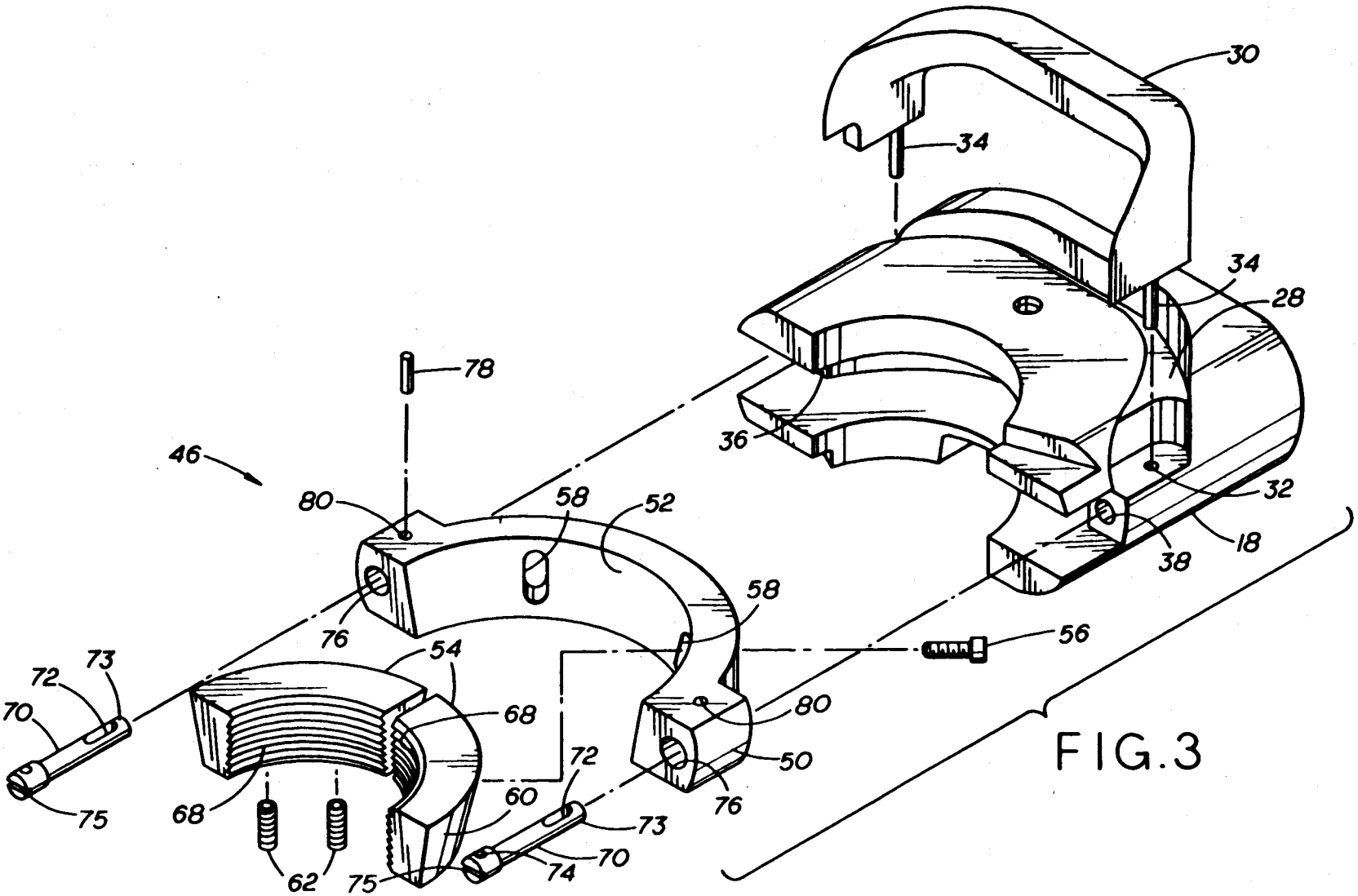
FIG. 3 is an exploded view of the improved string supporting ram assembly of the present invention.
Figure 4:
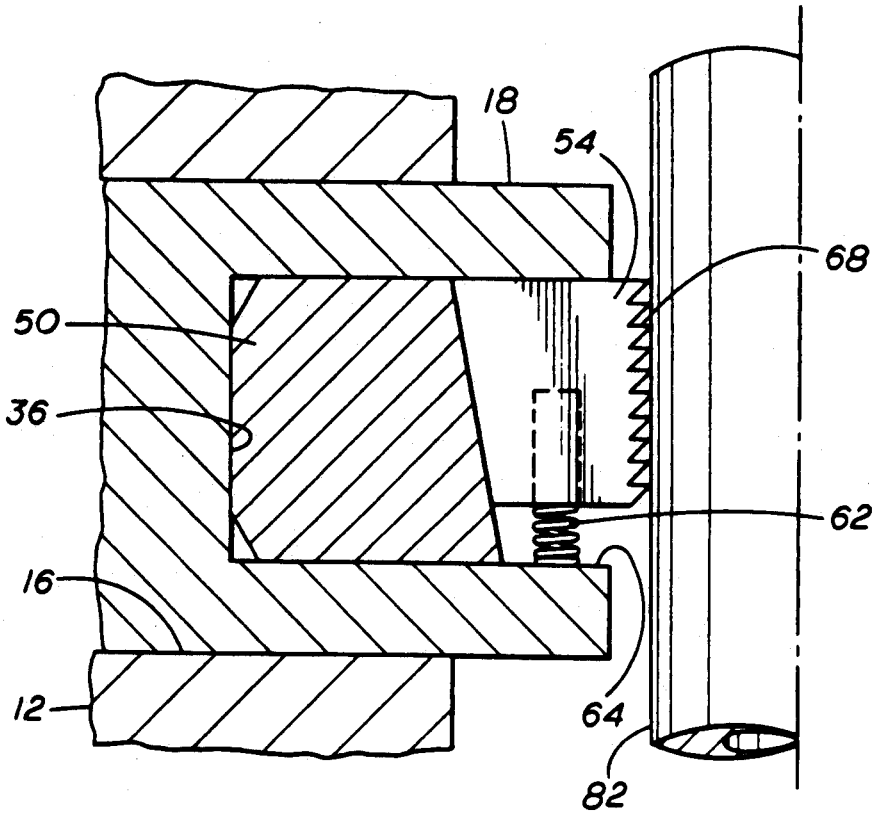
FIG. 4 is a detailed sectional view of the blowout preventer ram closed into initial engagement with a string extending through the central bore of the blowout preventer body.

With improved gripping assembly 46 of the present invention, as shown in FIG. 3, blowout preventer 10 can be converted from a unit in which its rams seal on the exterior of a string extending through central bore 14 to a unit in which its rams close on a string extending through central bore 14 and provide supporting engagement of such string as seen in FIG. 4. With the improved ram assembly of the present invention, rams 18 and top seals 30 are used with packer 40 removed from packer slot 36 and gripping assembly 46 is inserted within slot 36 as hereinafter described.

Gripping assembly 46 includes bowl body 50 which has substantially the same shape on its rear, top, bottom and sides as packer 40 an further includes arcuate face surface 52 which tapers downwardly and inwardly with respect to central bore 14 of blowout preventer 10. A plurality of gripping members or slips 54 are slidably mounted on face surface 52 by bolts 56 which extend through slotted openings 58 in bowl body 50 and are secured to the rear of each of slips 54. The rear surface 60 of slips 54 is tapered to mate with the taper of bowl surface 52. Means, such as springs 62, are provided to bias slips 54 upwardly with respect to bowl body 50. A suitable means (not shown) is provided to maintain springs 62 in their desired position abutting the upwardly facing surface 64 of slot 36 and within openings 60 in the lower surfaces of slips 54. The inner face of each of gripping slips 54 is provided with gripping teeth 66.

Pins 70, which have slots 72 in their shanks 73 and holes 74 in their head portions 75, are installed within openings 76 extending horizontally through bowl body 50 and pins 78 are inserted through holes 80 in bowl body 50 into holes 74 to secure the position of pins 70 so that they extend to the rear of bowl body 50 and have their slots 72 vertically aligned for receiving the pins 34 on top seal 30. Thus, when gripping assembly 46 is positioned within packer slot 36, it is locked in place by the interengagement of top seal pins 34 within slots 72 through bowl pins 70.

Figure 5:
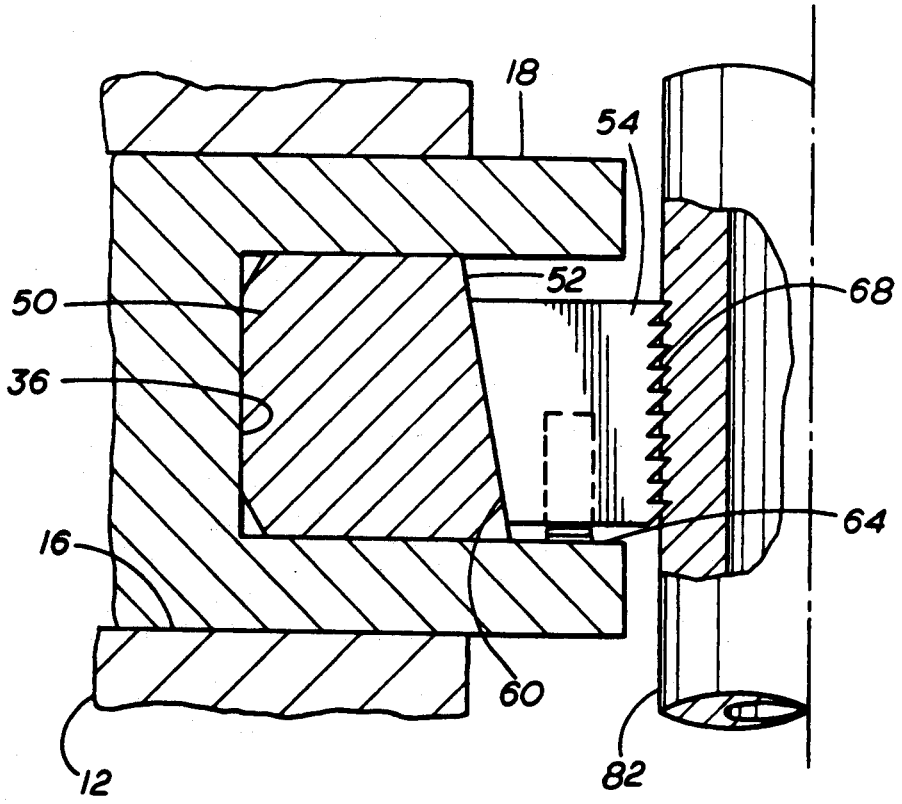
FIG. 5 is another detailed sectional view of the ram in supporting engagement with the string.

When gripping assembly 46 has been installed in rams 18, they are returned into their respective guideways 16, then the closing of rams 18 on pipe string 82 brings gripping teeth 66 of slips 54 into engagement with the exterior of string 82. Sufficient force is provided by pressure responsive means 20 to cause an initial supporting engagement of slips 54 with pipe string 82 as shown in FIG. 4. Thereafter, as additional weight of string 82 is taken by gripping assembly 46, slips 54 move downwardly against the slope of the inner surface 52 of bowl body 50 and the force of springs 62. As slips 54 move downwardly they are moved inwardly by the taper on the interior of bowl body 50 into tighter gripping and supporting engagement with pipe string 82 as shown in FIG. 5. As the weight is removed from string 82 and string 82 is lifted, slips 54 are move upwardly and thus are retracted slightly from engagement with pipe string 82. Thereafter, complete disengagement from pipe string 82 is accomplished by the retraction of rams 18 into their respective guideways by pressure responsive means 20.

What is claimed is:

1. An apparatus for supporting a tubular string within a well bore, comprising a body having means for connecting to a wellhead structure, a central bore therethrough an opposed, aligned guideways extending outward from the central bore, a ram positioned in each of said guideways, fluid pressure responsive means for moving each of said rams axially in their respective guideways, each of said rams including a ram body with a packer slot substantially of C-shape extending horizontally in a concave pattern across the face of the ram body, said packer slot being defined by both an upper and a lower outwardly extending horizontally positioned flange-like portion of said ram body, and a pipe gripping assembly including a bowl body shaped to be received in said packer slot with the interior of said bowl body facing said central bore and having an arcuate surface which tapers downwardly and inwardly, fastening means for fixedly securing said bowl body within said packer slot, a plurality of gripping members with each of said gripping members having a rear surface tapered to mate with said arcuate tapered surface of said bowl body, and means for slidably mounting said gripping members within said bowl body for movement along said tapered bowl surface in a vertical direction, each of said gripping members having a plurality of gripping teeth on the face thereof.

2. An apparatus according to claim 1 wherein said securing means includes pins extending into the ram body from each side of said bowl body, a top seal positioned within a groove extending across the top of said ram body and having pins extending downwardly through said ram body into engagement with said bowl body pins.

3. An apparatus according to claim 1 including means biasing each of said gripping members upwardly on said bowl surface.

4. An apparatus according to claim 1 wherein said gripping member mounting means includes at least one aperture borne by said bowl body and associated with each of said gripping members, each of said apertures having an elongated shape and having one opening on said arcuate surface of said bowl body and another opening on a side opposite said arcuate surface of said bowl body, each of said apertures extending completely through said bowl body to define an open slot positioned substantially vertically in said bowl body, and extending in a direction generally radially to said arcuate tapered front surface, and a separate fastening means extending through each of said open slots and connecting with one of said gripping members aligned with said fastening means.

5. A support apparatus for supporting a tubular string in a well bore comprising a body having means for connecting to a wellhead structure, a central bore therethrough an opposed, aligned guideways extending outward from the central bore, a ram positioned in each of said guideways, fluid pressure responsive means for moving each of said rams axially in their respective guideways, each of said rams including a ram body with a top seal groove extending across the top of said ram body from side to side, a first pair of openings in said body at the ends of said groove at each side, a packer slot substantially of C-shape extending horizontally in a concave pattern across the face of the ram body, said packer slot being defined by both an upper and a lower outwardly extending horizontally positioned flange-like portion of said ram body, and a second pair of openings in said ram body with each of said second pair of openings intersecting with said first pair of openings on their respective sides of the ram body;

a top seal formed to fill said top seal groove, said top seal having at least one pin on each end positioned to be received in one of said first pair of openings in said ram body when said seal is positioned in said groove; and a slip assembly including a semicircular bowl body shaped to be received in said packer slot and having a rearwardly extending pin at each side of said bowl body to be received in said second pair of openings, said bowl pins having openings therein to receive said top seal pins to secure said bowl body in said packer slot, the interior of said bowl body facing said central bore having an arcuate surface which tapers downwardly and inwardly, a plurality of arcuate gripping members, means for slidably mounting said gripping members within said bowl body for movement along said downwardly tapering surface in a vertical direction, and means biasing each of said gripping members upwardly on said bowl surface, each of said gripping members having a concave face surface with a plurality of teeth thereon for gripping a tubular member extending through said central bore.

6. A gripping assembly for a blowout preventer ram comprising a bowl body having a non-tapering arcuate rear surface, parallel top and bottom surfaces positioned substantially at right angles to said rear surface, and an arcuate front surface tapering downwardly and inwardly, a plurality of gripping members, means for slidably mounting said gripping members to said bowl body on said tapered surface so that said gripping members are movable upwardly and downwardly along said tapered surface, and fastening means extending from said bowl body for fixedly securing said bowl body to a blowout preventer ram body.

7. A gripping assembly according to claim 6 including means biasing each of said gripping members toward their respective upper positions with respect to said bowl body.

8. A gripping assembly according to claim 6 wherein said means for mounting said gripping members includes at least one aperture borne by said bowl body and associated with each of said gripping members, each of said apertures having an elongated shape and having one opening on said arcuate surface of said bowl body and another opening on a side opposite said arcuate surface of said bowl body, each of said apertures extending completely through said bowl body to define an open slot positioned substantially vertically in said bowl body, and extending in a direction generally radial to said arcuate tapered front surface, and a separate fastening means extending through each of said open slots and connecting into one of said gripping members aligned with said fastening means.

9. A gripping assembly according to claim 6 including means on said bowl body for securing said bowl body in a packer slot in said blowout preventer ram.

10. A gripping assembly according to claim 9 wherein said securing means includes a plurality of first pins extending from the rear surface of said bowl body, each of said first pins having a vertical opening extending transversely through a portion thereof near a distal end thereof.

11. A gripping assembly according to claim 10 wherein each of said first pins is a separate securing means including a head portion, and a shank portion having said vertical opening therein, said bowl body has openings at each side extending therethrough in a horizontal direction, and said first pins are positioned within said bowl body horizontal openings and extend beyond the rear face of said bowl body.

12. A gripping assembly according to claim 11 including a plurality of second pins each extending vertically into said bowl body and engaging said head portion of an adjacent one of said first pins to secure said first pins within said bowl body, each of said first pins resting substantially in a horizontal position within said bowl body.

* * * * *